US005430227A

United States Patent [19]

Erbse et al.

[11] Patent Number: 5,430,227

[45] Date of Patent: Jul. 4, 1995

[54] PROCESS FOR HANDLING LIQUID RADIOACTIVE WASTE

[75] Inventors: Dietmar Erbse, Rodenbach; Reinhard Thiele, Frankfurt; Helmut Walter, Offenbach, all of Germany

[73] Assignee: Siemens Aktiengesellschaft, Munich, Germany

[21] Appl. No.: 7,053

[22] Filed: Jan. 21, 1993

[30] Foreign Application Priority Data

Jul. 20, 1990 [DE] Germany ..... 40 23 161.5

[51] Int. Cl.[6] ..... G21F 9/00

[52] U.S. Cl. ..... 588/20; 210/739; 976/DIG. 381

[58] Field of Search ..... 252/631; 976/DIG. 381; 210/739; 588/20

[56] References Cited

U.S. PATENT DOCUMENTS

| | | | |
|---|---|---|---|
| 4,030,708 | 6/1977 | Stock et al. | 259/8 |
| 4,234,448 | 11/1980 | Hirano et al. | 252/626 |
| 4,354,954 | 10/1982 | Koster et al. | 588/2 |
| 4,396,541 | 8/1983 | Hesky et al. | 252/633 |
| 4,409,137 | 10/1983 | Mergan et al. | 252/632 |
| 4,638,674 | 1/1987 | Redmann | 73/863.12 |
| 4,800,042 | 1/1989 | Kurumada et al. | 588/20 |

FOREIGN PATENT DOCUMENTS 1639299 11/1972 Germany .

OTHER PUBLICATIONS

International Search Report.

*Primary Examiner*—Ngoclan T. Mai

*Attorney, Agent, or Firm*—Herbert L. Lerner; Laurence A. Greenberg

[57] ABSTRACT

A process for handling liquid radioactive waste includes evaporating liquid radioactive waste with condensation of vapors; refilling the waste during the evaporation; and measuring a condensate quantity and controlling the refilling with the measure of the condensate quantity. A device for handling liquid radioactive waste includes a device for evaporating liquid radioactive waste with condensation of vapors; a device for refilling the waste during the evaporation; a measuring vessel for collecting condensate; a valve for controlled drainage of the condensate from the measuring vessel; and a device connected to the valve for determining the condensate quantity removed from said measuring vessel. The device for determining the condensate quantity removed controls the refilling of the waste in accordance with the condensate quantity removed.

7 Claims, 1 Drawing Sheet

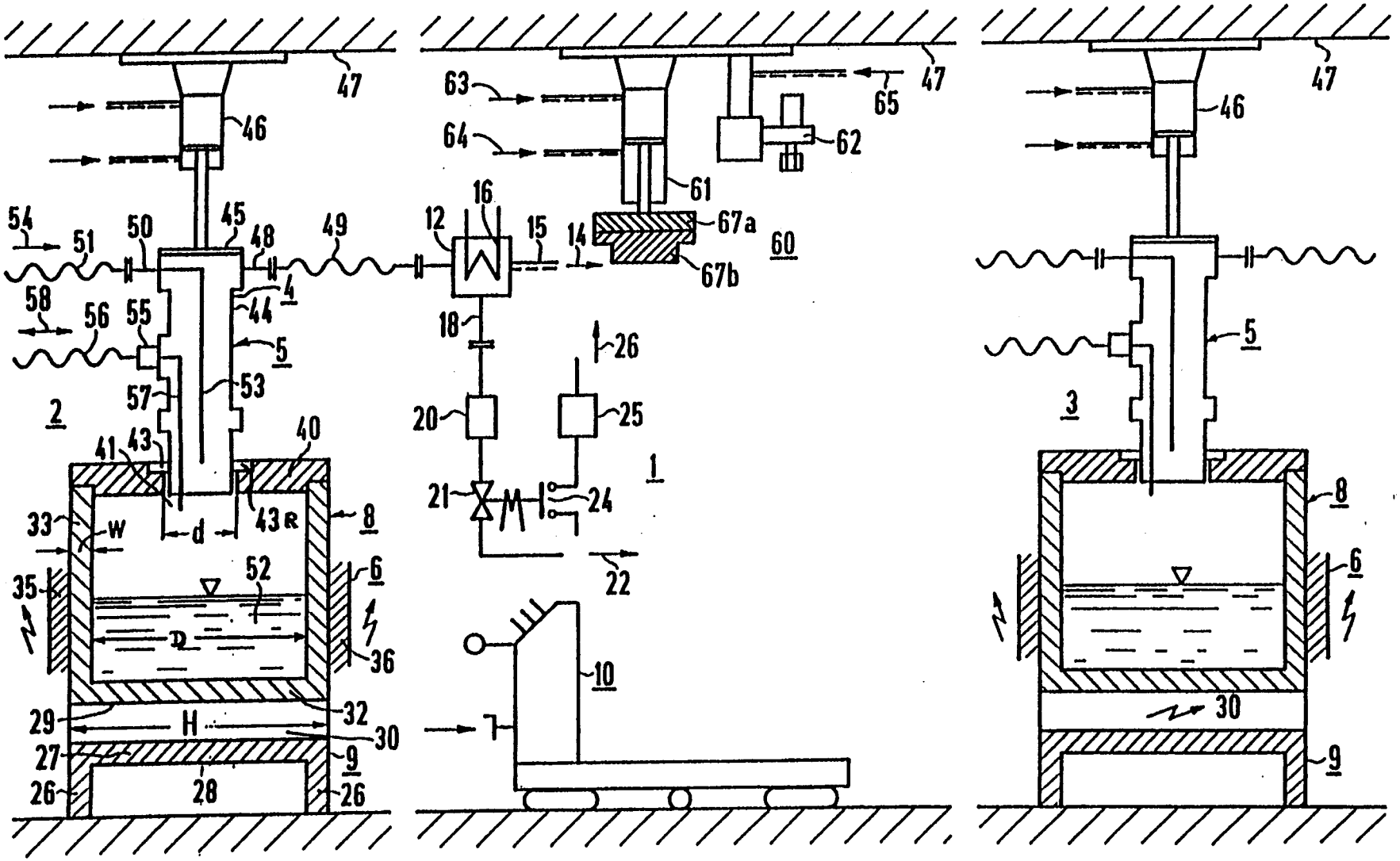
47
46
5
3
8
6
9
30
47
65
62
60
61
67a
67b
63
64
16
12
15
14
18
20
21
24
25
26
22
1
10
47
46
45
48
4
44
5
53
49
50
51
54
55
56
58
57
43
41
40
43R
52
d
D
H
W
2
8
6
36
32
30
9
26
28
33
35
29
27
26

PROCESS FOR HANDLING LIQUID RADIOACTIVE WASTE

CROSS-REFERENCE TO RELATED APPLICATION

This application is a continuation of International application Ser. No. PCT/DE91/00349, filed Apr. 25, 1991.

FIELD OF THE INVENTION

The invention relates to a process for handling liquid radioactive waste by evaporation with condensation of vapors, in which waste is resupplied during the evaporation. The invention also relates to a device for handling liquid radioactive waste.

In known in-drum drying processes, liquid radioactive operating waste is converted into a solid waste product by the thermal removal of water.

One such process is known from German Patent DE-PS 1 639 299, for example. In that device, for the purposes of refilling, the fill level of the vessel in which the evaporation is performed is ascertained. However, it is ascertained relatively inaccurately, which means that if overflow of refilled waste is to be reliably avoided, the final filling will be incomplete. A further consideration is that the instruments that measure the fill level are severely strained by heat and radiation and are correspondingly vulnerable to malfunction.

An attempt has also already been made to use a device in which refilling is effected as a function of the drum fill level, which is detected by measuring sensors that dip into it at various levels. With increasing travel time, however, such sensors tend to have baked-on residues or encrustation which again can lead to errors.

It is accordingly an object of the invention to provide a process and a device for handling liquid radioactive waste, which overcome the hereinafore-mentioned disadvantages of the heretofore-known methods and devices of this general type and which improve the control of refilling.

With the foregoing and other objects in view there is provided, in accordance with the invention, a process for handling liquid radioactive waste, which comprises evaporating liquid radioactive waste with condensation of vapors; refilling the waste during the evaporation; and measuring a condensate quantity and controlling the refilling with the measure of the condensate quantity.

In the invention, direct measurement of the radioactive waste (concentrate), which is problematic, is replaced by measurement of the relatively clean condensate, which is unproblematic. This measurement can be performed outside the radiation zone and with using simple means, as will be described in detail below.

In accordance with another mode of the invention, there is provided a process which comprises measuring the condensate with a measuring vessel, in particular liter by liter. With this fill level measurement, the measuring instrument can be evacuated through a valve. The number of times that the valve is opened then corresponds to a certain quantity of condensate, which is used to control the refilling.

In accordance with a further mode of the invention, there is provided a process which comprises specifying a certain quantity of condensate with a timer that then initiates refilling, if the incident condensate is uniform. The refilling can likewise be controlled in accordance with the incident condensate using a timer that assures correct refilling.

In accordance with an added mode of the invention, there is provided a process which comprises performing the evaporation discontinuously, and interrupting the evaporation process as a function of the condensate quantity.

In accordance with an additional mode of the invention, there is provided a process which comprises drawing off the vapors with negative pressure, and cancelling the negative pressure from time to time as a function of the condensate quantity by feeding air, so that the refilling can be performed at normal pressure or at a pressure elevated by a pump. With this combination of measurement of the incident condensate with timer control after certain fixtures are opened or if certain fixtures are present, it is simple both to control the refilling and to detect the end of the drying process.

In accordance with yet another mode of the invention, there is provided a process which comprises feeding the waste into a sealable container in which the drying then also takes place. To that end, the fill level of the container is monitored. The fill level can be used for the final shutoff of refilling.

In accordance with a concomitant mode of the invention, there is provided a process which comprises terminating the refilling as a function of a dynamic pressure measurement.

The container is preferably a shielded container and in particular a cast iron container, with a relatively great wall thickness. It may also be an authorized final disposal container.

With the objects of the invention in view, there is also provided a device for handling liquid radioactive waste, comprising means for evaporating liquid radioactive waste with condensation of vapors; means for refilling the waste during the evaporation; a measuring vessel for collecting or catching condensate; a valve for controlled drainage of the condensate from the measuring vessel; and a device connected to the valve for determining the condensate quantity removed from the measuring vessel, the device having means for controlling the refilling of the waste in accordance with the condensate quantity removed.

Other features which are considered as characteristic for the invention are set forth in the appended claims.

Although the invention is illustrated and described herein as embodied in a process and a device for handling liquid radioactive waste, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The drawing is a diagrammatic, partly sectional, side-elevational view of an exemplary embodiment of the invention.

DESCRIPTION OF THE PREFERRED EMBODIMENT

Referring now to the single FIGURE of the drawing in detail, there is seen a device 1 that is used for in-drum drying of liquid radioactive waste of the kind produced in a nuclear power plant with a pressurized or boiling water reactor, for example. Above all, the waste is so-called evaporator concentrates, that is residue from the system for treating radioactive waste water, which primarily is formed of water-soluble salts, such as boric acid salts. Under some circumstances, suspensions and slurries of filter resins or the like may be handled by the process of the invention.

By way of example, the drive 1 includes two drying stations 2 and 3, which are disposed next to one another in a building, only parts of which are shown, and each of which has a filling adapter 5 and a heater 6. The drying stations 2 and 3 are charged with identical barrels or shielded containers 8, which sit on transport pallets 9. In order to transport the pallets 9, the device 1 may include a hovercraft transporter 10, as an example. Instead, some other transport device may also be used, such as an electrically driven device, or especially a rail vehicle.

The transport pallets 9 have feet 26 which are located on both sides of a pallet bottom 27 to form an intermediate space or clearance 28. The hovercraft transporter 10 can move into this intermediate space. A top 29 of each pallet 9, on which the shielded container 8 is located, is formed by a supplementary heater 30. In the exemplary embodiment, an electric supplementary heater 30 is indicated. However, steam could also be used as the heating energy, for example.

The shielded container 8 is preferably made of cast iron. The shielded container 8 is constructed in one piece and has a bottom 32 and a preferably cylindrical, relatively thick shielding or side wall 33 with a width w. The electric heater 6 rests on the side wall 33, once its two shells 35 and 36, which are secured to the applicable drying station 2, 3 in such a way that they are swivelable in a horizontal plane, have been folded together to form a heating mantle that largely encloses the shielded container 8.

A lid 40 of the shielded container 8 may also preferably be made of cast iron. The lid 40 has a central opening 41 formed therein, having a circular cross section and a diameter d that is a small fraction (such as 1/10) of the inside diameter $D=H-2w$ of the shielded container 8, wherein H is the outside diameter of the shielded container 8. The filling adapter 5 has a fitting cross section which protrudes into the opening 41 and a flange 43 which fits on the lid 40 in a fitting recess 43R.

The filling adapter 5 has an external housing 4 in the form of a tube 44 with a vertical axis, which is sealed with a sealing lid 45 on its upper end and is vertically adjustably secured to a compressed air or electric drive 46, for example. The compressed air drive 46 is assigned to the applicable drying station 2 or 3 and is secured to a building ceiling 47, for instance, or to a stage.

The tube 44 is a first part of a suction apparatus for vapors that occur during drying and concentration and that are vented to a condenser 12 through a lateral connection 48 with a hose connection 49. The condenser 12 is evacuated by suction using a non-illustrated water ring pump, as is indicated by an arrow 14 at a line 15. A cooling coil 16 of the condenser 12 is connected to a coolant system.

Condensate is removed from the lower surface or underside of the condenser 12 through a line 18 and reaches a collecting or measuring vessel 20 of a defined volume. Through the use of this measuring vessel 20, the condensate quantity is determined in a known manner, for example by measuring its weight or fill level. Once an intended fill level, such as one liter, for example, is reached, the measuring vessel 20 is evacuated by opening a valve 21, as is indicated by an arrow 22. The quantity of water that has escaped from the shielded container 8 and is to be replaced by refilling can thus be determined accurately and at little effort or expense from the condensate quantity, for example from the number of times the valve 21 has opened. To that end, a contact 24 is provided on the valve 21 for triggering a timer and counter 25. An arrow 26 indicates that the refilling is controlled by the timer and counter 25.

Diagonally opposite the connection 48 is a connection 50, to which a hose 51 is secured as part of a charging line. The hose 51 serves for controlled venting of the container 8 during drying of the container contents or in other words of radioactive waste 52. The liquid radioactive waste 52 to be dried is delivered through the charging line 51 and then reaches the inside of the shielded container 8 without touching the inner walls of the housing 4. Specifically, the radioactive waste 52 is delivered through an inlet tube 53 that preferably extends in the center of the tube 44. The charging, which is indicated by an arrow 54, is controlled as a function of the condensate quantity by opening a non-illustrated valve.

At the connection 50, a further connection 55 with a hose 56 is provided on the housing 4 and leads to a non-illustrated compressed air source. The compressed air, which is represented by a double-headed arrow 58, acts upon a fill level gauge 57 in the filling adapter 5 that operates by the dynamic pressure measuring principle. Measurement is performed only during filling of the shielded container 8.

During drying, a negative pressure, for example of 0.2 bar absolute, is generated by the suction apparatus 44, 48, 49. The dynamic pressure measurement serves the purpose of final shutoff and of monitoring the determination of the concentrate quantity according to the invention.

The shielded container 8 is filled or refilled with concentrate in increments. Once filling is complete, when the contents 52 have been dried, the filling adapter 5 is removed upward from the lid 40, so that the shielded container 8 can be taken by the hovercraft transporter 10 to a manipulator or a sealing station 60. The sealing station 60 includes a plug installer 61 and a screwing tool 62, which are secured next to one another on the building ceiling 47 or stage, for example. The plug installer 61 and the screwing tool 62 are both preferably actuated by compressed air, for example, as is indicated by arrows 63, 64 and 65. Instead, an electrical drive may be used. The plug installer 61 has a piston drive and executes a vertical motion with which a plug **67*b* that is detachably secured to a lifting element 67*a*, is inserted into the opening 41 in the lid 40. As seen in section, this plug is T-shaped. The plug 67*b* is secured in place with the aid of the screwing tool 62, producing a package that is appropriate for final disposal, which is then taken to a non-illustrated transfer station by the hovercraft transporter 10. From the transfer station, it is removed to a temporary or final disposal site. The plug 67*b* can also be removed from the opening 41 in the lid 40 at the beginning of the filling process, through the use of the plug installer 61. The filling adapter 5 can be structurally combined with the installer 61 and/or the screwing tool 62**.

The following summary can be made: The vapors that are produced in drying at a more or less pronounced vacuum are condensed, and the relatively clean condensate is caught in the collecting vessel 20 which has a defined volume. Once the fill level measurement has responded, this condensate quantity is drained out to a container or to a building sump in the direction of the arrow 22. The number of times that the valve 21 opens is recorded. Once the condensate quantity (preselected at the counter 25) has been produced or once the timer 25 indicates that the period within which a certain condensate quantity must have been produced has elapsed, the refilling is initiated in accordance with the arrow 54. The refilling is performed after the system has been vented and is terminated again by a fill level measurement. By combining measurement of the incident condensate and timing control of the period after certain fixtures have been opened or certain signals have been present, it is possible in a simple manner both to control and assure the discontinuous refilling and to recognize and detect the end of the drying process.

We claim:

1. A process for handling liquid radioactive waste, which comprises:

filling liquid radioactive waste into a container;

discontinuously evaporating liquid radioactive waste with a subsequent condensation of vapors;

replenishing the waste during the evaporation;

measuring a condensate quantity and controlling the replenishing with the measure of the condensate quantity; and interrupting the evaporating step as a function of the condensate quantity.

2. The process according to claim 1, which comprises measuring the condensate by fill level detection with a measuring vessel; emptying the measuring vessel through a valve; and controlling the replenishing according to the number of times that the valve opens.

3. The process according to claim 2, which comprises measuring the condensate liter by liter with the measuring vessel.

4. The process according to claim 1, which comprises controlling the refilling in accordance with the incident condensate with a timer.

5. The process according to claim 1, which comprises drawing off the vapors at negative pressure, and intermittently cancelling the negative pressure by feeding air as a function of the condensate quantity.

6. The process according to claim 1, which comprises filling the waste into a sealable container, and monitoring the container for determining a final shutoff of the refilling.

7. The process according to claim 1, wherein the filling step comprises terminating the refilling as a function of a dynamic pressure measurement.

* * * * *